US010499791B2

(12) United States Patent
Seltz

(10) Patent No.: US 10,499,791 B2
(45) Date of Patent: Dec. 10, 2019

(54) DRINKING STRAWS CLEANING SYSTEM

(71) Applicant: Jacob Seltz, Minneapolis, MN (US)

(72) Inventor: Jacob Seltz, Minneapolis, MN (US)

( * ) Notice: Subject to any disclaimer, the term of this patent is extended or adjusted under 35 U.S.C. 154(b) by 0 days.

(21) Appl. No.: 15/485,560

(22) Filed: Apr. 12, 2017

(65) Prior Publication Data

US 2017/0216890 A1 Aug. 3, 2017

(30) Foreign Application Priority Data

Aug. 18, 2016 (CN) ..... 2016 2 09084257 U

(51) Int. Cl.

| | |
|---|---|
| ***B08B 9/04*** | (2006.01) |
| ***A47L 17/00*** | (2006.01) |
| ***B08B 9/043*** | (2006.01) |

(52) U.S. Cl.

CPC ..... *A47L 17/00* (2013.01); *B08B 9/0436* (2013.01)

(58) Field of Classification Search

CPC ..... B08B 9/0436; B08B 9/045

See application file for complete search history.

(56) References Cited

U.S. PATENT DOCUMENTS

| | | | | |
|---|---|---|---|---|
| 5,407,423 | A * | 4/1995 | Yoon | A61B 17/00234 15/244.1 |
| 6,045,623 | A * | 4/2000 | Cannon | A61M 25/00 134/8 |
| 6,699,331 | B1 * | 3/2004 | Kritzler | A61B 17/221 134/22.11 |
| 6,889,402 | B2 * | 5/2005 | Galantai | B08B 9/00 15/104.05 |
| 2009/0044353 | A1 * | 2/2009 | Galantai | B08B 9/0436 15/104.16 |
| 2013/0305469 | A1 * | 11/2013 | Rodriguez Sanjuan | A61B 1/122 15/104.05 |
| 2015/0313681 | A1 * | 11/2015 | Eikens | A61B 19/34 15/104.05 |

* cited by examiner

*Primary Examiner* — Randall E Chin

(74) *Attorney, Agent, or Firm* — Johnson & Phung LLC; Thomas N. Phung

(57) ABSTRACT

Disclosed is a drinking straws cleaning system. Embodiments of the present invention discloses a drinking straws cleaning system that includes a flexible tubular elongated shaft including a first end, a second end, a body portion disposed in between the first end and the second end, a holding member configured at the second end, and one or more flaps configured proximal to the holding member at the second end, wherein the flexible tubular elongated shaft is passed through a hollow cavity of a straw through a top opening until the first end of the flexible tubular elongated shaft emerges out of a bottom opening of the straw, and then pulled therethrough to fully emerge out of the hollow cavity of the straw to clean the straw.

6 Claims, 5 Drawing Sheets

DRINKING STRAWS CLEANING SYSTEM

CROSS-REFERENCE TO RELATED APPLICATION

This application claims priority benefit from Chinese Application No. CN 2016209084257, filed on Aug. 18, 2016, the content of which is incorporated in its entirety by reference.

FIELD OF THE INVENTION

The present application generally relates to cleaning systems and in particular, it relates to a drinking straws cleaning system.

BACKGROUND

Nowadays, many people prefer to drink using a straw after the purchase of packaged beverages or drinks. Similarly, many reusable drinking vessels are provided with drinking straws. Hence, the straw plays an active role in our daily life due to its high availability. Further, if the straw is a reusable straw, then a user need to clean the straw before using it again. It is difficult to clean the straw if the straw is used for a drink that is sticky in nature. It would be a benefit, therefore, to have a drinking straws cleaning system that could be used to thoroughly clean a fluid passageway or hollow cavity of a drinking straw.

Drinking straws cleaning brushes are available in the art, such as one shown in FIG. 1A-1B. Such drinking straws cleaning brush 1 mainly include bristles 2, and a hook 4 for hanging and easy access of the brush 1. These brushes 1 although designed for cleaning the inner surfaces of the straws 100, many times such brushes 1 fail to reach tight spots inside the straws 100 and thus don't effectively clean around corners of the straws 100. Further, bodies of such commercially available straws cleaning brushes 1 are made from stainless steel and bristles made of hard plastic material, which may cause scratches within the inner surfaces of the straws 100, if they are not operated carefully.

Many other variations of drinking straws cleaning brushes are found proposed in the art, such as in design U.S. Pat. Nos. D360,301 and D532,978. However, as discussed above, they are directed towards the aesthetic appearance and uses hard bristles for cleaning the inner surfaces of straws and many times such bristles fail to reach tight spots or corners within the straws for effective cleaning.

U.S. Pat. No. 6,039,490A by Banks et al. discloses a cleaning system for cleaning drinking straws. The drinking straw cleaning system as disclosed in the patent includes a flexible, tubular brush structure having a tubular cavity formed between a closed insertion end and an open ended, threaded squeeze bulb reservoir connecting end, a number of cleaning solution dispensing orifices provided along the length of the flexible tubular brush structure and a number of multi-length bristles extending radically outward from the flexible tubular brush structure.

U.S. Pat. No. 5,699,578A by Dumler et al. discloses about a cleaning device. The cleaning device according to the disclosure includes two twisted, wire-type sections. The cleaning being accompanied by the application of care and cleaning agents, that the wire-type sections are twisted in such a way that at least one free loop or eye is formed.

Thus, in the light of the above mentioned background art, it is evident that, there is a need for drinking straws cleaning system that would overcomes or at least ameliorate the problems associated with existing cleaning systems.

The above information is presented as background information only to help the reader to understand the present invention. Applicant has made no determination and makes no assertion as to whether any of the above might be applicable as Prior Art with regard to the present application.

BRIEF SUMMARY

Before the present systems and methods, enablement are described, it is to be understood that this application is not limited to the particular systems, and methodologies described, as there can be multiple possible embodiments which are not expressly illustrated in the present disclosures. It is also to be understood that the terminology used in the description is for the purpose of describing the particular versions or embodiments only, and is not intended to limit the scope of the present application.

An objective of the present invention is to provide a straw cleaning system.

Another object of the embodiments herein is to provide a mechanism where the straw cleaning system is pulled through a hollow cavity of a straw to clean interior surfaces of the straw.

Another object of the embodiments herein is to provide a drinking straws cleaning system made of silicon material that ensures no scratches are left over within the interior surfaces of the straw when the drinking straws cleaning system is used for cleaning the straws.

Another object of the embodiments herein is to provide a drinking straws cleaning system that can easily reach out all the tight spots inside the straws and facilitate all around cleaning through all the corners within the cavity of the straws.

According to an aspect of the present invention, there is provided a drinking straws cleaning system. The system includes a flexible tubular elongated shaft including a first end, a second end, a body portion disposed in between the first end and the second end, a holding member configured at the second end, and one or more flaps configured proximal to the holding member at the second end; wherein the flexible tubular elongated shaft is passed through a hollow cavity of a straw through a top opening until said first end of the flexible tubular elongated shaft emerges out of a bottom opening of the straw, and then pulled therethrough to fully emerge out of the hollow cavity of the straw to clean the straw.

According to the same aspect, the flexible tubular elongated shaft is made of silicone material.

The features and advantages described in this summary and in the following detailed description are not all-inclusive, and particularly, many additional features and advantages will be apparent to one of ordinary skill in the relevant art, in view of the drawings, and specification thereof. Moreover, it should be noted that the language used in the specification has been principally selected for readability and instructional purposes, and may not have been selected to delineate or circumscribe the inventive subject matter.

BRIEF DESCRIPTION OF THE DRAWINGS

The foregoing summary, as well as the following detailed description of preferred embodiments, is better understood when read in conjunction with the appended drawings. There is shown in the drawings example embodiments, however, the application is not limited to the specific system and method disclosed in the drawings.

DETAILED DESCRIPTION

Some embodiments, illustrating its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any methods, and systems similar or equivalent to those described herein can be used in the practice or testing of embodiments, the preferred methods, and systems are now described. The disclosed embodiments are merely exemplary.

The embodiments herein disclose a drinking straws cleaning system capable of providing higher performance in terms of cleaning interior surfaces or walls of a straw and avoid any scratches in the interior surfaces of the straws. The drinking straws cleaning system, as proposed by present disclosure includes a flexible tubular elongated shaft including a first end, a second end, a body portion disposed in between the first end and the second end, a holding member configured at the second end, and one or more flaps configured proximal to the holding member at the second end. The flexible tubular elongated shaft or the drinking straws cleaning system, as disclosed is initially passed through a hollow cavity (i.e., fluid passageway) of the straw through a top opening of the straw until the first end of the flexible tubular elongated shaft or the drinking straws cleaning system emerges or slides out of a bottom opening of the straw, and then the first end of the flexible tubular elongated shaft is pulled therethrough to fully emerge or slide out of the hollow cavity of the straw to clean interior surfaces of the straw.

Figure 1A:
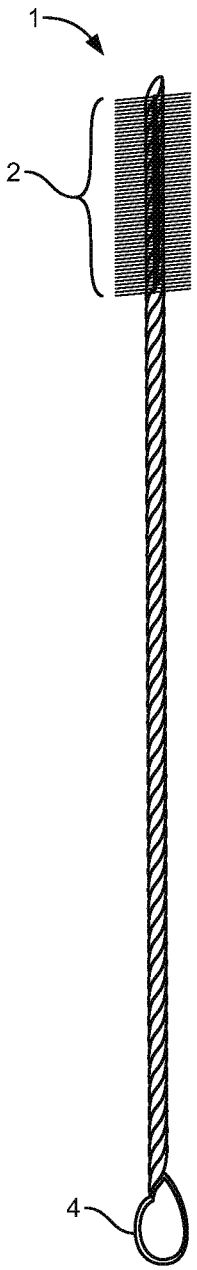
(PRIOR ART) FIG. 1A
FIG. 1A-1B illustrates an example drinking straws cleaning brush existing in the art and its method of use for cleaning drinking straws.
Figure 1B:
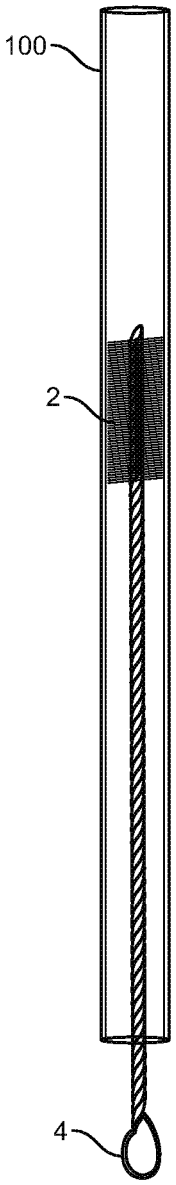
(PRIOR ART) FIG. 1B

In the conventional systems and methods, for example as shown in FIG. 1A-FIG. 1B, it is difficult to clean interior surfaces of the straw 100 if the straw 100 is used for a drink that is sticky in nature. As shown, such systems 1 are not flexible and don't provide optimum performance in terms of cleaning interior surfaces of the straws 100. The brush like conventional drinking straws cleaning system includes bristles 2, and a hook 4 for hanging and easy access of the brush 1. These sort of brushes 1 are although designed for cleaning the inner surfaces of straws 100 commercially available, many times such brushes 1 fail to reach tight spots inside the straws 100 and thus don't effectively clean around corners of the straws 100. Further, mostly, bodies of such commercially available drinking straws cleaning brush 1 are made from stainless steel material and bristles 2 are made of hard plastic material which may cause scratches within the inner surfaces of the straws 100, if they are not operated carefully. Also, during operation, the straws 100 are only able to be cleaned at only one side using such conventional brush 1 at one time.

Unlike the conventional systems and methods of operation associated therewith, the proposed drinking straws cleaning system provides a unique solution for cleaning the straws and that is capable of providing optimum performance when used for cleaning drinking straws which are used with the sticky drink (e.g., the drink that is sticky in nature). The proposed straw cleaning system includes one or more flaps for effective cleaning of interior surfaces which will be discussed in detail in the following description. Further, the proposed drinking straws cleaning system involves a pull through mechanism that ensures better cleaning of interior surfaces of the straws. Further, the proposed straw cleaning system mitigates the risk of scratches within the interior surfaces (or walls) of the straw by using silicone material.

The various features and embodiments of the drinking straws cleaning system are explained in conjunction with the description of FIGS. 2-5.

Figure 2:
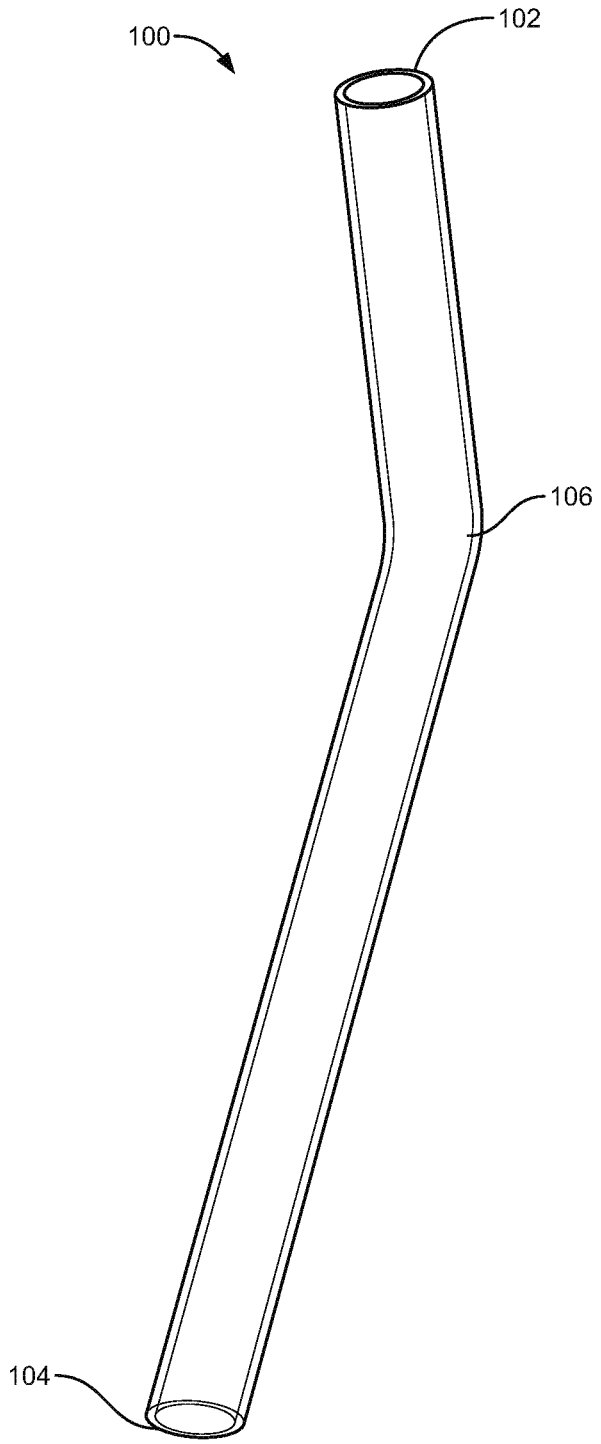
FIG. 2 illustrates an example drinking straw commercially used with beverages.

Referring to FIG. 2 illustrates an example drinking straw commercially used with beverages. Representative of the straw 100 is an elongated plastic tube open at two ends, namely a top end 102 and a bottom end 104 and connected by a fluid passageway or a hollow cavity 106. Although the term straw is used herein but it should not be considered as limitation, the term straw may mean any tubular structure used to suck consumable fluids (any drinks) from a reservoir, for example fluid contained in a glass. Further, the straw 100 may be at least partially constructed from one or more of fibers, silicone, plastic, leather, rubber, pro-vinyl, and any other suitable material. As should be understood, a user can suck the consumable fluids using any one of the two ends 102 and 104 and the consumable fluids flow through the fluid passageway 106 when the user sucks the consumable fluids using the straw 100. The scope of the invention is not intended to be limited to the length, width, or diameter, in general dimensions of the straw 100 and material composition used during manufacturing and/or shape of the straw 100.

Figure 3:
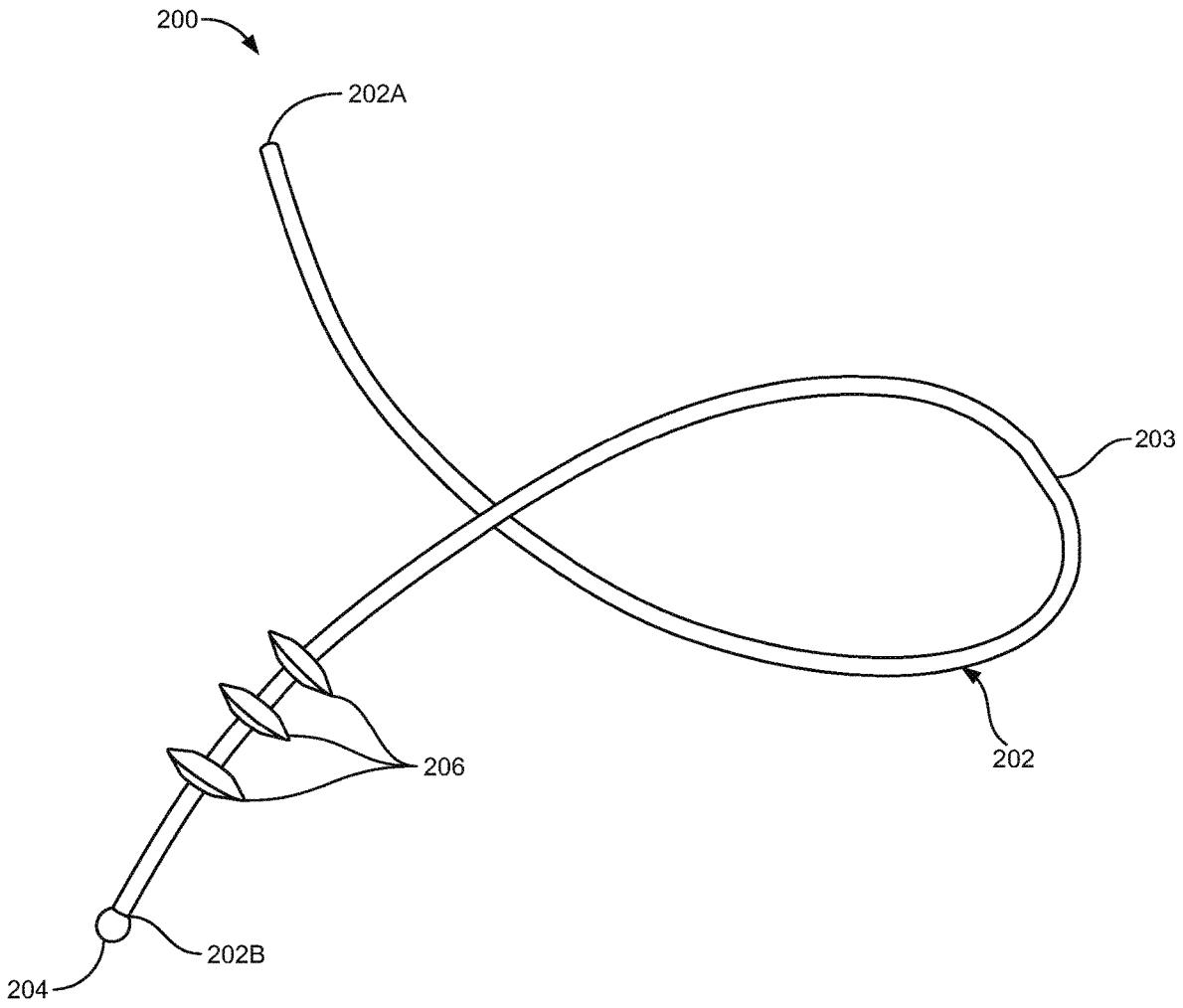
FIG. 3 illustrates drinking straws cleaning system, in accordance with an embodiment of the present invention.

Referring to FIG. 3 illustrates drinking straws cleaning system, in accordance with an embodiment of the present invention. As shown, the drinking straws cleaning system 200 include a flexible tubular elongated shaft 202 with a first end or a leading end 202*a*, a second end or a trailing end 202*b* and a body portion 203 disposed in between the first end 202*a* and the second end 202*b*. The body portion 203 of the flexible tubular elongated shaft 202 comprise of uniform diameter throughout its length and preferably have smaller diameter than diameter of the commercially available straws 100 such that the flexible tubular elongated shaft 202 can be slidably inserted within the hollow cavity 106 of the straw 100.

The drinking straws cleaning system 200 further include a holding member 204 configured at the second end 202*b*. The holding member 204 is preferably spherical in shape and facilitate in handling of the system 200.

The drinking straws cleaning system 200 further include one or more flaps 206 preferably molded onto the body portion 203 proximal to the holding member 204 at the second end 202*b*. According to another embodiment, the one or more flaps 206 proximal to the holding member 204 at the second end 202*b* may be collapsible. The one or more flaps 206 may preferably have a diameter more than diameter of the body portion 203 of the flexible tubular elongated shaft 202 and the diameter slightly lesser than that of the internal diameter of the straw 100 commercially available so that the flaps 206 can slide against the interior walls or surfaces of the straw 100. Although a set of three flaps 206 are shown in the FIG. 3, it should be understood that the system 200 may have more or less number of flaps 206. The flaps 206 as shown are preferably circular in shape. The scope of the invention is not intended to be limited to the number of flaps, width or dimension in general, and material composition used during manufacturing and/or shape of the flaps 206. According to an embodiment, the one or more flaps 206 proximal to the holding member 204 at the second end 202*b* may contain or embody a cleaning solution to clean the straw 100.

According to the embodiment, the cleaning system 200 of present invention is preferably made of silicone material. In another embodiment, the drinking straws cleaning system 200 may be made of a rubber or like material. The scope of the invention is not intended to be limited to the length, width, material composition used during manufacturing and/or shape of the straw cleaning system 200. Unlike the conventional cleaning systems, the proposed system 200 does not scratch the wall (i.e., fluid passageway 106) of the straw 100 as the straw cleaning system 200 is made up of silicone material.

Figure 4:
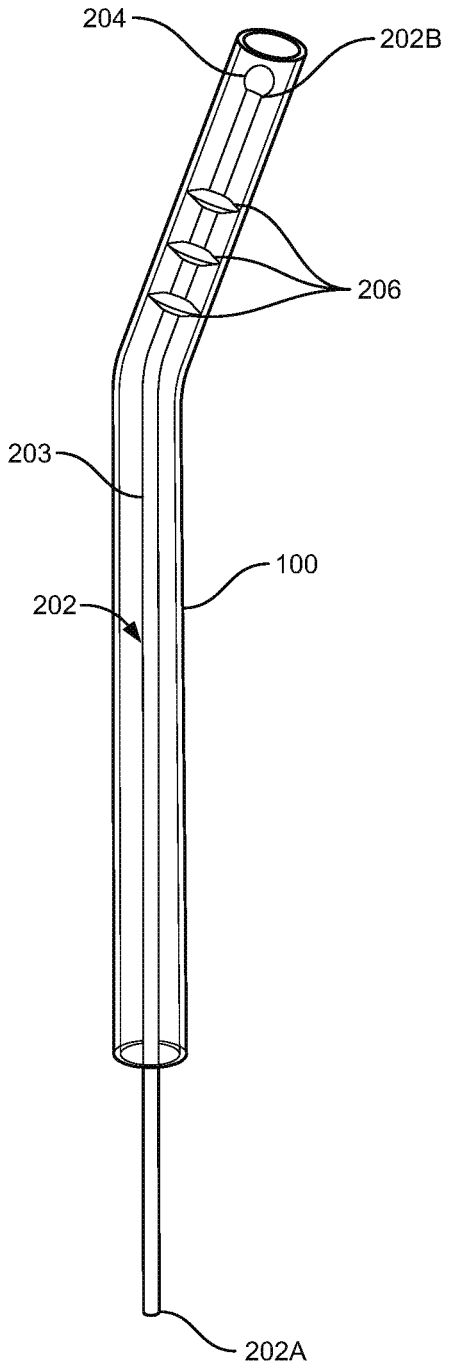
FIG. 4 illustrates drinking straws cleaning system in use inside the example drinking straw of FIG. 2, in accordance with an embodiment of the present invention.

Referring to FIG. 4 illustrates drinking straws cleaning system in use inside the example drinking straw of FIG. 2, in accordance with an embodiment of the present invention. As seen, the length of the drinking straws cleaning system 200 or the flexible tubular elongated shaft 202 is preferably more than the standard length of the commercially available straws 100.

Figure 5A:
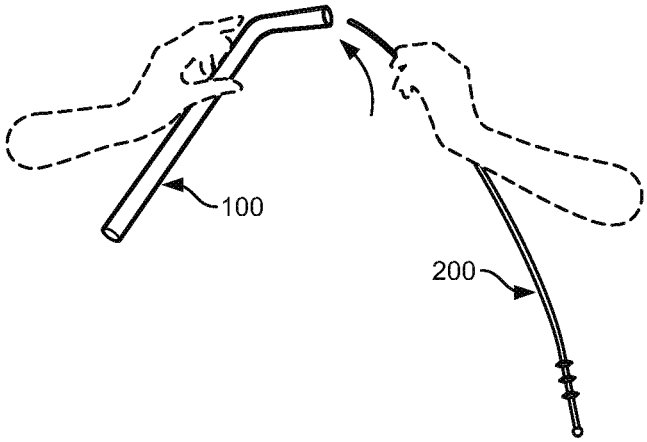
FIG. 5A-5C illustrates a pull through mechanism associated with the drinking straws cleaning system of FIG. 3 that ensures better cleaning.
Figure 5B:
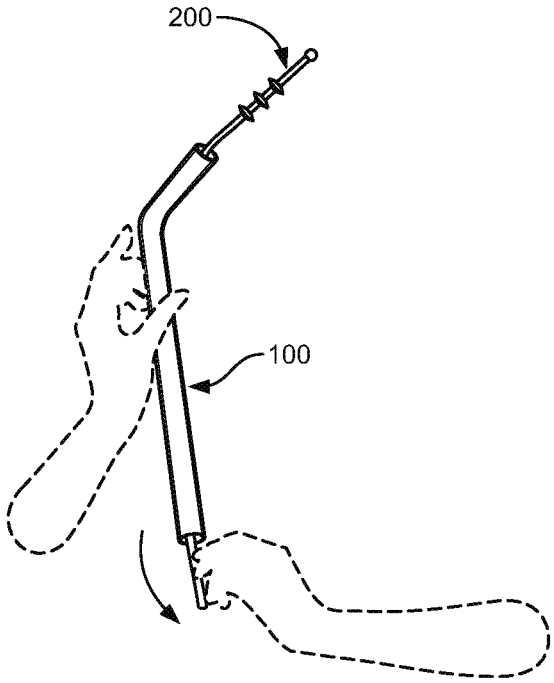
Figure 5C:
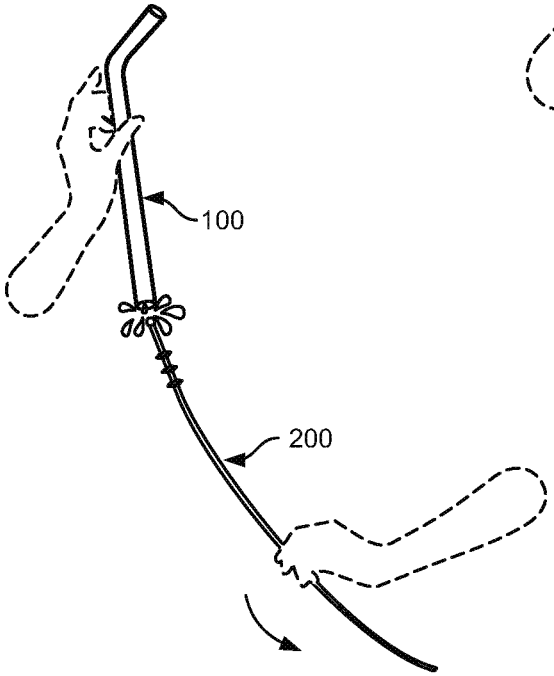

In operation, firstly, the leading end or the first end 202*a* of the flexible tubular elongated shaft 202 is inserted through a top opening or end 102 of the straw 100 (as shown in FIG. 5A) and then the body portion 203 of the flexible tubular elongated shaft 202 is slidably pushed inside the hollow cavity 106 of the straw 100 until the first end 202*a* of the flexible tubular elongated shaft 202 comes out of bottom end or opening 104 of the straw 100 (as shown in FIG. 5B). Thereafter, the user pulls the flexible tubular elongated shaft 202 to completely slide out of the hollow cavity 106 of the straw 100 preferably with a small force (as shown in FIG. 5C), it helps in cleaning interior surfaces or walls of the hollow cavity 106 of the straw 100. The one or more flaps 206 embodied onto the body portion 203 proximal to the holding member 204 of the flexible tubular elongated shaft 202 slide against the interior walls or surfaces of the straw 100 (as shown in FIG. 3). The sliding of the flaps 206 against the interior walls or surfaces of the straw 100 forces any material (sticky in nature) present within the hollow cavity 106 of the straw 100 to slide out of the straw 100 because of this pulled through mechanism. Unlike the traditional method and systems, the proposed pull through mechanism adapted by the cleaning system 200 ensures better cleaning inside the interior surfaces of the straw 100. Although, not explained with reference to FIGS. 4-5, it should be understood that the flaps 206 may embody some cleaning solutions available in the art, that may be manually placed over the flaps before the system 200 undergo pull through mechanism so as to even better clean the interior surfaces of the straw 100.

The FIGS. 2-5 shows a limited overview of the drinking straws cleaning system 200, it is to be understood that other embodiments may be possible. Further, the drinking straws cleaning system 200 can include any number of units along with other material used for manufacturing thereof. The illustrations of arrangements described herein are intended to provide a general understanding of the structure of various embodiments, and they are not intended to serve as a complete description of all the elements and features of apparatus and systems that might make use of the structures described herein. Many other arrangements will be apparent to those of skill in the art upon reviewing the above description. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

The preceding description has been presented with reference to various embodiments. Persons skilled in the art and technology to which this application pertains will appreciate that alterations and changes in the described structures and methods of operation can be practiced without meaningfully departing from the principle, spirit and scope.

What is claimed is:

1. A drinking straws cleaning system, comprising:
   a flexible tubular elongated shaft including a first end, a second end, a body portion disposed in between said first end and said second end,
   a spherical shaped holding member configured at said second end, and one or more drinking straw interior wall surface engaging flaps molded onto and radially extending from the body portion proximal to said holding member at the second end, said one or more flaps embody a sticky drink cleaning solution, said sticky drink cleaning solution assisting said drinking straw interior wall surface engaging flaps in removing sticky drink materials from said interior surface of a used drinking straw;
   wherein said flexible tubular elongated shaft is passed through a hollow cavity of said drinking straw through a top opening until said first end of said flexible tubular elongated shaft emerges out of a bottom opening of said drinking straw, and then pulled therethrough to fully emerge out of said hollow cavity of said drinking straw to clean interior walls of the hollow cavity of said drinking straw.

2. The drinking straws cleaning system of claim 1, wherein said body portion of said flexible tubular elongated shaft comprising a uniform diameter throughout its length.

3. The drinking straws cleaning system of claim 1, wherein said flexible tubular elongated shaft is made of silicone material.

4. The drinking straws cleaning system of claim 1, wherein said one or more flaps being collapsible.

5. A drinking straws cleaning system, comprising:
   a flexible tubular elongated shaft including a first end, a second end,
   a body portion disposed in between said first end and said second end,
   a spherical shaped holding member configured at said second end, and one or more drinking straw interior wall surface engaging flaps molded onto and radially extending from the body portion proximal to said holding member at the second end, said one or more drinking straw interior wall surface engaging flaps being collapsible and embody a sticky drink cleaning solution, said sticky drink cleaning solution assisting said drinking straw interior wall surface engaging flaps in removing sticky drink materials from said interior surface of said a drinking straw;

wherein said flexible tubular elongated shaft is passed through a hollow cavity of said drinking straw through a top opening until said first end of said flexible tubular elongated shaft emerges out of a bottom opening of said drinking straw, and then pulled therethrough to fully emerge out of said hollow cavity of said drinking straw to clean interior walls of the hollow cavity of said drinking straw.

6. A drinking straws cleaning system comprising:

a used plastic drinking straw having an interior wall surface containing a sticky material left over from a sticky drink;

a flexible tubular elongated shaft including a first end, a second end, a body portion disposed in between said first end and said second end, a spherical shaped holding member configured at said second end, and one or more drinking straw interior wall surface engaging flaps molded onto and radially extending from the body portion proximal to said holding member at the second end, said one or more flaps embody a sticky drink cleaning solution, said sticky drink cleaning solution assisting said drinking straw interior wall surface engaging flaps in removing said sticky material from said interior wall surface of said used drinking straw;

said flexible tubular elongated shaft passing through a hollow cavity of said used drinking straw through a top opening until said first end of said flexible tubular elongated shaft emerges out of a bottom opening of said drinking straw, and then pulled therethrough to fully emerge out of said hollow cavity of said drinking straw to clean interior walls of the hollow cavity of said drinking straw.

* * * * *